US006241417B1

(12) United States Patent
Schlutius

(10) Patent No.: US 6,241,417 B1
(45) Date of Patent: Jun. 5, 2001

(54) PROCESS AND A DEVICE FOR THE ATTACHMENT OF AN OBJECT, ESPECIALLY A DATA CARRIER DISK, TO A SURFACE, ESPECIALLY A PRINT MEDIUM

(76) Inventor: Walter Schlutius, Hygin-Kiene-Strasse 5, 83607 Holzkirchen (DE)

( * ) Notice: Subject to any disclaimer, the term of this patent is extended or adjusted under 35 U.S.C. 154(b) by 0 days.

(21) Appl. No.: 09/171,770

(22) PCT Filed: Mar. 13, 1997

(86) PCT No.: PCT/DE97/00498

§ 371 Date: Oct. 23, 1998

§ 102(e) Date: Oct. 23, 1998

(87) PCT Pub. No.: WO97/35731

PCT Pub. Date: Oct. 2, 1997

(30) Foreign Application Priority Data

| | | |
|---|---|---|
| Mar. 22, 1996 | (DE) | 196 11 255 |
| Nov. 11, 1996 | (DE) | 196 46 397 |
| Dec. 12, 1996 | (DE) | 296 21 587 U |
| Jan. 19, 1997 | (DE) | 197 03 106 |

(51) Int. Cl.[7] ..... B42F 5/00
(52) U.S. Cl. ..... 403/270; 206/308.1
(58) Field of Search ..... 206/308.1, 232; 403/270, 266, 265, 278, 280, 282, 283; 411/920

(56) References Cited

U.S. PATENT DOCUMENTS

| | | | | |
|---|---|---|---|---|
| 4,007,950 | * | 2/1977 | Giulie | 411/920 X |
| 4,129,059 | * | 12/1978 | Van Eck | 411/920 X |
| 4,793,477 | * | 12/1988 | Manning et al. | 206/232 |
| 4,850,731 | * | 7/1989 | Youngs | 206/308.1 X |
| 4,925,029 | * | 5/1990 | Friedman et al. | 206/473 |
| 5,048,681 | * | 9/1991 | Henkel | 206/308.1 X |
| 5,704,472 | * | 1/1998 | Werner et al. | 206/232 |
| 5,775,490 | * | 7/1998 | Baker et al. | 206/308.1 |

FOREIGN PATENT DOCUMENTS

| | | |
|---|---|---|
| 2 693 348 | 1/1994 | (FR) . |
| 141 611 | 4/1920 | (GB) . |
| 341 146 | 10/1929 | (GB) . |
| 2 275 891 | 9/1994 | (GB) . |

* cited by examiner

*Primary Examiner*—Lynne H. Browne
*Assistant Examiner*—John R. Cottingham
(74) *Attorney, Agent, or Firm*—Henry M. Feiereisen; Ursula B. Day

(57) ABSTRACT

To fasten an object (8) to a surface (4) such as in a booklet, the object (8) is fastened to the surface (4) which is subsequently, optionally, bound like a page into a booklet. The time-consuming action of inserting the objects (8) into bags and fastening the bags to the predetermined pages of the booklet is thus avoided. It is consequently simple and economical to carry out the method according to the invention.

1 Claim, 5 Drawing Sheets

PROCESS AND A DEVICE FOR THE ATTACHMENT OF AN OBJECT, ESPECIALLY A DATA CARRIER DISK, TO A SURFACE, ESPECIALLY A PRINT MEDIUM

The invention concerns a process and a device for the attachment of an object especially a data carrier disk to a surface, especially a print medium.

The term "data carrier disk" means so-called CD ROMs or other disks which store digitally variable or invariable data; especially so-called compact disks. Such data carriers are frequently inserted in magazines or books in order to provide the user with additional information which he is able to read or further process with a special playback unit. However, the invention is also applicable to small flasks of perfume, cream samples, supplements, material samples and other objects.

Print media for instance are books, magazines, folders, supplements or similar information carriers made of paper, foil or similar materials while the information carriers in exceptional cases can also be without print.

In order to attach the object or the data carrier disk to a book or magazine the data carrier disk for instance is inserted in a paper or foil pocket and this pocket is glued to one page of the book or magazine. Frequently the data carrier disk is directly arranged behind the cover of the book or magazine. This makes it possible with a punched-out window in the cover to provide a view of the data carrier disk attached in the book or magazine.

However, the insertion of data carrier disks or other objects in paper pockets or foil pockets is highly labor intensive and only possible in large quantities with highly complicated machines. In addition the delivery, singling out, positioning and gluing of the bags onto a special page of a book or magazine requires sophisticated machinery. As a consequence the distribution of data carrier disks in books or magazines requires very expensive machinery which ultimately increases the manufacturing cost and consequently the price of the books or magazines.

The invention is based on the task of developing a process and a device of the type described above in order to attach objects such as data carrier disks to a surface such as a print medium easily and at a favorable price.

This task according to the process is solved in that the object is placed on the surface or the surface on the object for attachment there. This surface can subsequently also be bound to a print medium.

In this process the data carrier disk in a first process step is placed on a surface such as a plate of paper or cardboard and attached to it. This process step is technically far easier accomplished than the insertion of a data carrier disk into a bag since it is understandably simpler to place a data carrier disk with its level side onto a surface than introducing it with high precision into a flexible bag. Even the attachment of the data carrier disk to the surface is easily accomplished by gluing or other means of attachment.

In a second process step the surface to which the object is attached can be bound to a print medium such as a book or magazine. In this process the surface is so placed between the pages of the book or magazine that it is included in the binding process of the book or magazine. As a result no additional devices for positioning and gluing small bags are required when binding the book or magazine but the surface according to the invention is bound into the book or magazine like an ordinary book page.

The mentioned process steps can be accomplished with known machines at a favorable price, rapidly and in high quantities with high precision. As a consequence the quantity that can be processed per unit time can be increased on the one hand while known simple machines can be employed on the other.

It is advantageous for the process according to the invention if the object for attachment is at least partly coated with a layer, especially a foil and the layer is attached to the surface. This foil on the one hand serves to protect the data carrier disk. On the other hand however the foil can also cover the data carrier disk at least in part and serve for the attachment of the data carrier disk to the surface. Beside these functional advantages of the foil a foil is also suited to increase the impression of value.

The device according to the invention for the attachment of an object, especially a data carrier disk to a surface, especially a print medium, such as a book or magazine is characterized by a means of attachment for the attachment of an object placed on the surface. Preferably the means of attachment are chosen so that an adequate attachment is achieved simply by the placing on top of another or pressing onto another of object and surface or of a layer covering the object and the surface.

This permits a highly simplified construction of the machines to be used.

The means of attachment can also include a mechanical means of attachment such as a staple. Such staples made of plastic or metal can for instance be pushed through a central hole of a data carrier disk and the surface below, retaining the data carrier disk on the surface with the head of the staple and the legs which deform during the attachment. The staple can also be attached to the surface similar to a press stud.

The mechanical means of attachment according to an embodiment can be so constructed that it is automatically destroyed when removing the object. For instance the manufacture from polystyrene with intended breaking points results in a seal effect the break of which for instance could be tied with the acceptance of license conditions for the data carrier disk. It is also possible to use a bonding surface where the bond created by the bonding surface is firmer than one of the materials bonded to the bonding surface. Consequently, the surface to which it was attached will be damaged when detaching the object.

It is advantageous if the means of attachment is formed by an embossing provided in the surface. An embossing provided in the surface for instance permits a detachable attachment of a data carrier disk to the surface without the need for additional means of attachment. Here the circumference of the data carrier disk and/or its whole area can serve for attachment.

In order to facilitate the attachment it is advantageous in many cases if the surface is provided with a recess into or onto which the object can be placed. This for instance facilitates at least the partial covering with a layer or foil of the object.

A simple attachment for instance of a data carrier disk to a surface is also possible by using a glue or bonding element such as for instance a bonding pad or a bonding layer. Such bonding facilities are known and widely distributed.

A particularly elegant kind of attachment is achieved in that the means of attachment possesses a layer attached to the surface at least partially covering the object. Such a layer is preferably a foil which on the one hand enables the joining of the data carrier disk with the surface and increases the impression of value of the device on the other.

A simple attachment is achieved in that the layer at least partly is self-adhesive preferably at the point at which it is attached to the surface. In order to avoid a reaction between object and surface it is advisable to provide the layer with glue only at its outer edge at which it comes into contact with the surface.

Especially thicker objects would result in folds in the foil when attached by means of a foil. It is therefore advantageous if the foil is stretchable for instance through heating up or possesses a structure which permits that the layer is deformed when placed on the object or even assumes the shape of the object.

A preferred embodiment of the layer provides that it possesses holes or is gas permeable in order to hold an object arranged on the layer by means of a suction element arranged on its side. This makes it possible with a suction head to first take up the foil and subsequently, with the same suction head holding the foil, to take up another object which is subsequently placed on a surface together with the foil. With this principle several air permeable elements as layer structure can be held by the same suction head and positioned together in one position.

By means of holes in the layer and/or the object held by the suction head it is also possible to pass an additional suction head through the layer and/or the object in order to take up additional objects on the side opposite the suction head.

The holes in the layer or their gas permeability consequently permit a gripping of the layer and at least another object. Depending on the control of the vacuum the parts can be gripped and placed simultaneously or consecutively.

It is advantageous if the surface is provided with a binding area. The means of attachment permits a simple attachment for instance of a data carrier disk and the binding area is so designed that the surface can be bound into a book or magazine with known binding facilities. For a magazine with wire stitch the binding area must be so designed that the stitch wire can be passed through the surface and the binding area must be so dimensioned that tearing out of the surface during customary handling of the magazine is avoided. In the case of glued binding the binding area with regard to flexibility and material properties must be so designed that an impairment of the usual binding process is avoided.

In order to comply with these requirements the surface or at least the binding area in preferably made of paper or cardboard. Since book binders are familiar with the processing of paper, cardboard, toils and similar material the use of these materials is particularly suited for the purpose according to the invention. In addition paper or cardboard can be easily printed, easily punched and is recyclable together with a book or magazine.

A special embodiment of the invention provides that the binding area divides the surface in two parts. Here it is possible to attach the data carrier disk to one part of the surface while the other part of the surface can be provided with information or be constructed as a detachable card.

An embodiment of the device according to the invention provides that this surface is provided with a perforation for instance between a means of attachment and binding area. Such a perforation permits the removal for instance of a data carrier disk from the book together with a part of the surface which for instance can contain additional information on the data carrier disk.

On the other hand the perforation can also largely follow the outline of the object. This makes it even possible for instance to detach and remove a data carrier disk permanently connected with the surface and to play back the data carrier disk on a playback unit without removing the part of the surface. The surface then serves as imprint for the compact disk.

Provided the object is covered with a layer the perforation in the surface permits the removal from the package formed by layer and surface. As an alternative it is also possible to provide such a perforation in the layer.

A exemplified embodiment of the invention will now be described in more detail with reference to the drawing in which.

Figure 12A:
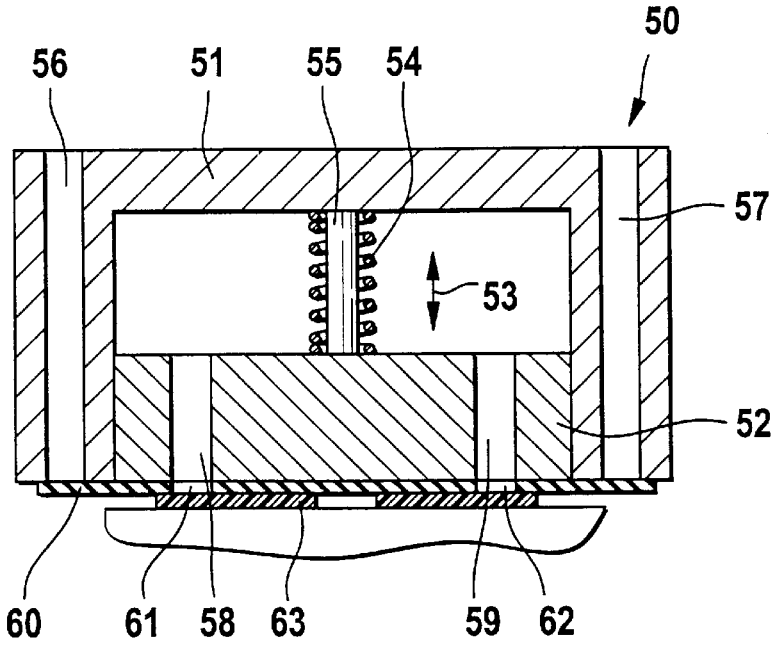

FIG. 12. shows the function of a suction head for gripping foil and CD.

Figure 1:
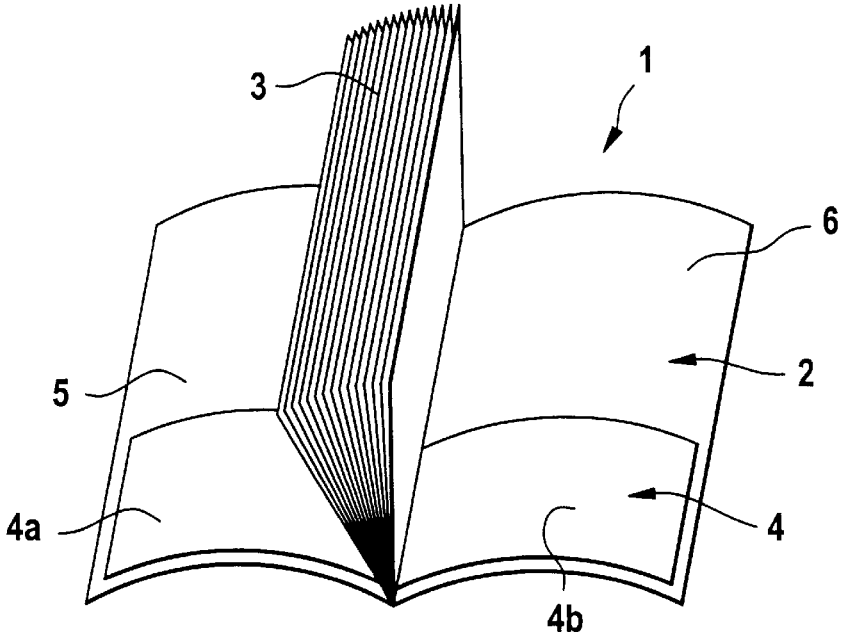
FIG. 1 shows a magazine with a bound surface in perspective representation.

The magazine 1 shown in FIG. 1 mainly consist of a cover 2 and back wire stitched bound pages 3, of which only three are shown in the drawing. Between the pages 3 and the cover 2 a surface 4 is bound consisting of a paper approximately possessing the strength of the paper of the cover page 2. In the shown design example the surface 4 is situated between the cover 2 and the pages 3, i.e. a part 4*a* is situated between the front sheet 5 of the cover 2 and a part 4*b* of the surface 4 is positioned between the pages 3 and the back sheet 6 of the cover 2.

Figure 2:
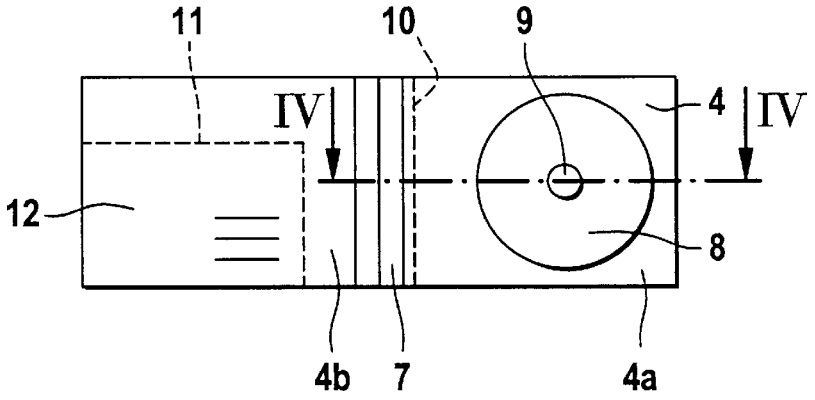
FIG. 2 shows a top view of the bound surface.

The surface 4 bound into the magazine 1 is once again drawn separately in FIG. 2. Here it is clearly visible that the parts 4*a* and 4*b* of the surface 4 are separated from each other by a binding area 7. At least this binding area 7 must possess material properties which permit the binding of the surface 4 into the magazine 1.

A data carrier disk 8 detachably attached to the surface 4 with a means of attachment 9 is placed on the part 4*a* of the surface 4. In addition a perforation following in the direction of the binding area is provided on part 4*a* of the surface 4 which facilitates the removal of part 4*a* of the surface 4 together with the data carrier disk 8 from the magazine 1.

The other page 4*b* of the surface 4 possesses a part 12 designed as a postcard which is detachable by means of a perforation 11. In the present case the entire surface 4 approximately has the thickness of a postcard. This permits a stable attachment of the data carrier disk 8 to the surface 4, a simple binding of the surface 4 into the magazine 1 and additionally the use of a part of the surface 4 as a detachable reply card.

Figure 3:
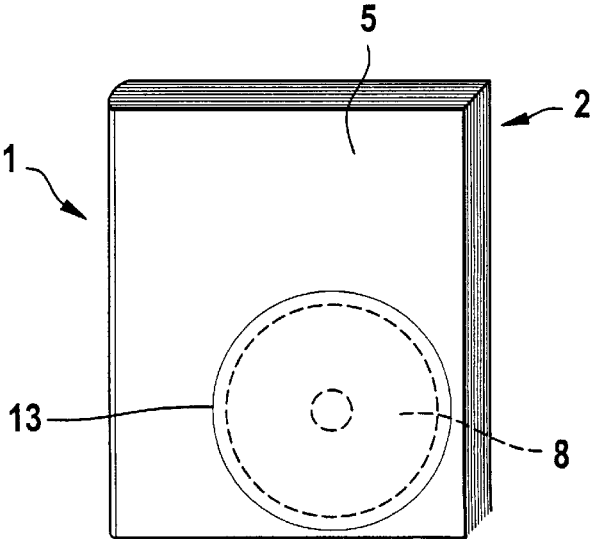
FIG. 3 shows a front view of a magazine with bound surface.

FIG. 3 shows the closed magazine 1 with bound surface 4, attached to which is the data carrier disk 8. In the front sheet 5 of the cover 2 a punch-out 13 is provided which permits a view of the data carrier disk 8.

Figure 4:
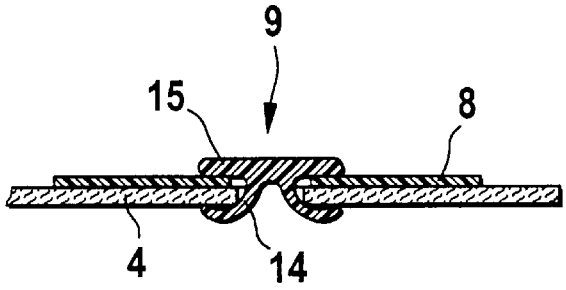
FIG. 4 shows a part of a section through the surface along the line IV—IV in FIG. 2.

The attachment of the data carrier disk 8 to the surface 4 is shown in FIG. 4 and it is clearly visible here how the means of attachment 9 as a staple passes through the hole in the data carrier disk 8. Upon application of the staple 9 the legs 14 of the staple spread out so that the data carrier disk 8 is pressed against the surface 4 with the head 15 of the staple 9.

In order to put the data carrier disk 8 into the magazine 1 a surface 4 is first punched out of a cardboard and the data carrier disk 8 placed flat onto this surface 4. At the same time as the placement or after the placement the data carrier disk 8 is attached to the surface 4 by stapling, gluing or pressing into a matched shape on the surface 4. The surface 4 thus prepared is finally bound into the magazine 1 like a page, providing the data carrier disk 8 with a fixed position within the magazine.

Other possibilities of attachment for instance of a compact disk on a surface which on the one hand can be the print medium or b) bound into the print medium are represented by FIGS. 5 to 8.

Figure 5:
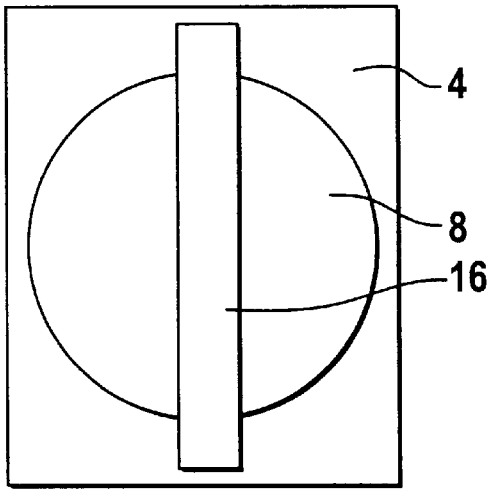
FIG. 5 shows a compact disk attached with a foil strip.

In FIG. 5 the data carrier disk 8 is attached to the surface 4 by means of a strip of adhesive tape 16. The strip of adhesive tape 16 is so flexible that it smoothly clings to the data carrier disk 8 and provided with an adhesive layer on one side which on the one hand holds the data carrier disk 8 on the adhesive tape and on the other hand the adhesive tape 16 on the surface 4.

Figure 6:
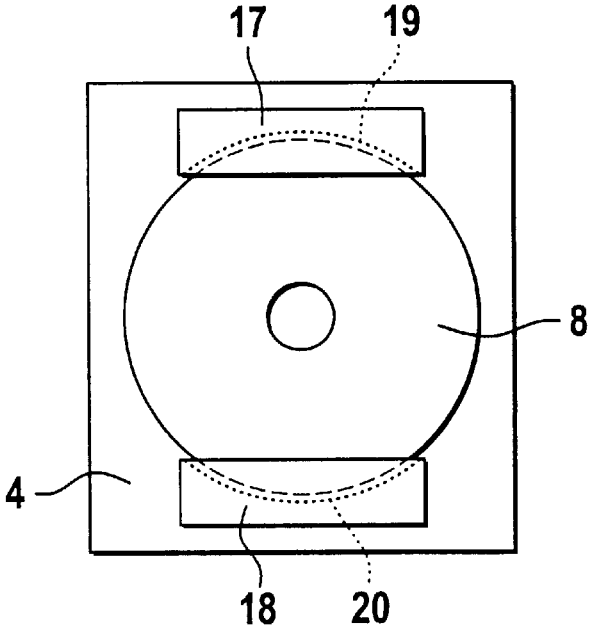
FIG. 6 shows a compact disk attached with two foil strips.

In FIG. 6 the data carrier disk 8 is attached to the surface 4 by means of two adhesive strips 17 and 18. Perforations 19 and 20 can facilitate the removal of the data carrier disk from the surface in this case.

Figure 7:
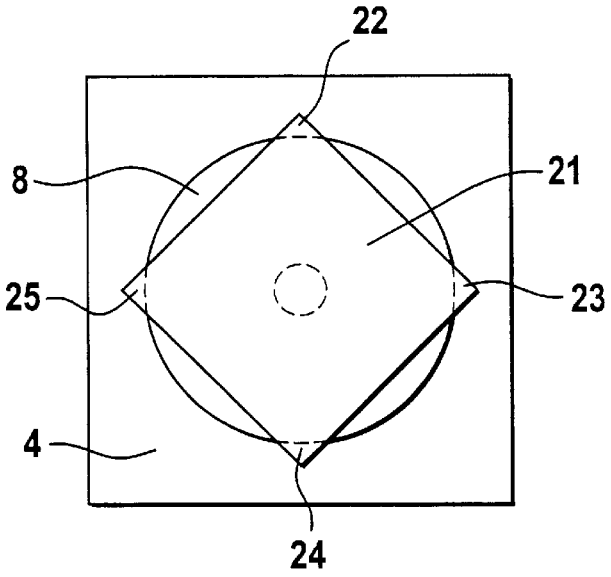
FIG. 7 shows a compact disk attached with a foil square.

In FIG. 7 the entire data carrier disk 8 is attached to the surface 4 with a square foil 21. For this purpose the corners 22 to 25 which protrude over the data carrier disk 8 are coated with adhesive in order to attach the foil 21 to the surface 4. Optionally the entire foil 21 can be of the self-adhesive type.

Figure 8:
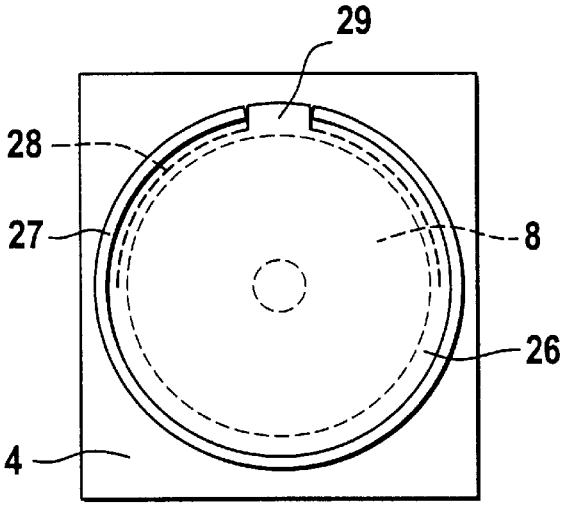
FIG. 8 shows a compact disk attached with a circular foil.

FIG. 8 shows an attachment possibility where the data carrier disk 8 is situated below a circular foil 26 which with its outer edge is glued to the surface 4. This foil 26 has a semi-circular perforation 28 between the bonding area 27 and the outer edge of an inserted data carrier disk 8 which can be torn open by means of a strap 29 in order to remove the data carrier disk 8 arranged under the foil 26 from the surface 4 of the print medium. The pocket created by breaking open the perforation 26 can be repeatedly used as storage location for the data carrier disk 8 while through the initial breaking open of the perforation 28 a seal is being broken which is easily noticeable and cannot be reversed. Such a seal is of particular interest for guarantees or licenses.

Figure 9:
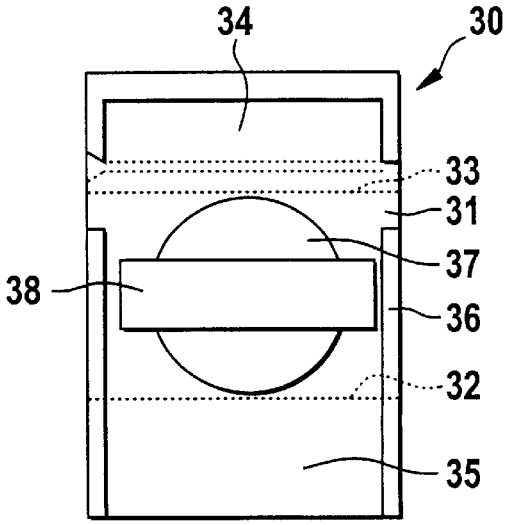
FIG. 9 shows an example of a mailing card for a compact disk.

The mailing bag 30 shown in FIG. 9 consists of a cardboard 31 provided with two parallel spaced grooves 32, 33 by means of the one upper end 34 and one lower end 35 of which the cardboard 31 can be folded in. An adhesive closure 36 provided at the edges of the cardboard 31 permits the bonding on top of another of the ends 34 and 35 in this way resulting in an envelope-type closed package. A compact disk 37 is placed in this package which in this location is positioned by means of an adhesive strip 38. This adhesive strip 38 prevents a slipping of the compact disk 37 during packaging.

Figure 10:
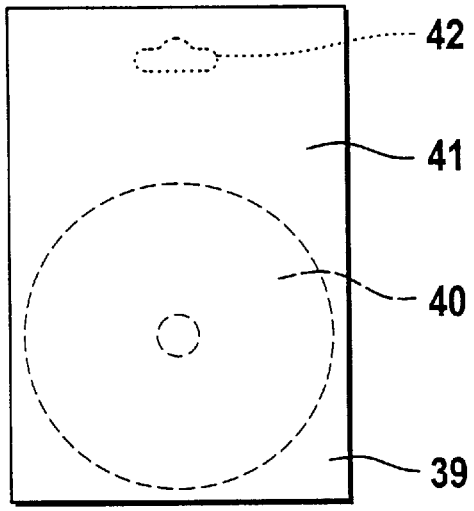
FIG. 10 shows a compact disk package.

A very simple, extremely thin package for a CD is shown in FIG. 10. A CD 40 is placed on a cardboard 39. Subsequently the surfaces of the cardboard 39 and the CD are covered with foil 41. The Europe hole 42 serves to suspend the package from known facilities.

Figure 11A:
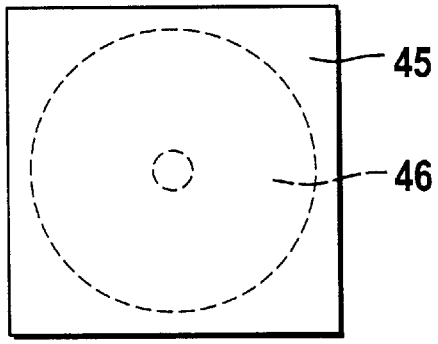
FIG. 11 shows a CD package with detachment perforation.
Figure 11B:
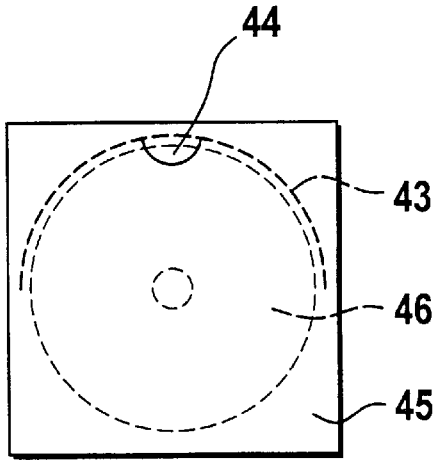

FIG. 11*a* shows a similar package with a construction according to FIG. 10 wherein the back of the package shown in FIG. 11 b is provided with a semi-circular perforation 43 and a finger hole 44 by means of which the cardboard 45 can be opened at the shown place in order to remove the CD 46.

The press stud 50 shown in FIG. 12 consists of an external cylinder 51 in which an internal cylinder 52 is movably guided along the arrow 53. A spring 54 with a stroke element 55 guided therein is shown as a guide. Vacuum passages 56, 57 are located in the outer cylinder 51 and vacuum passages 58, 59 are located in the inner cylinder 52. This press stud 50 can be placed onto a foil 60 and can grip and hold the foil by means of the vacuum passages 56, 57. In the foil 60 are provided the holes 61, 62 which are in alignment with the vacuum passages 58, 59 of the internal cylinder 52. The suction head 50 with sucked-on foil 60 can therefore be positioned for instance over a compact disk 63 in order to suck-on and hold the compact disk 63 by means of a second vacuum applied to the inner cylinder 52 by way of the vacuum passages 58, 59 and the holes 61, 62.

Figure 12B:
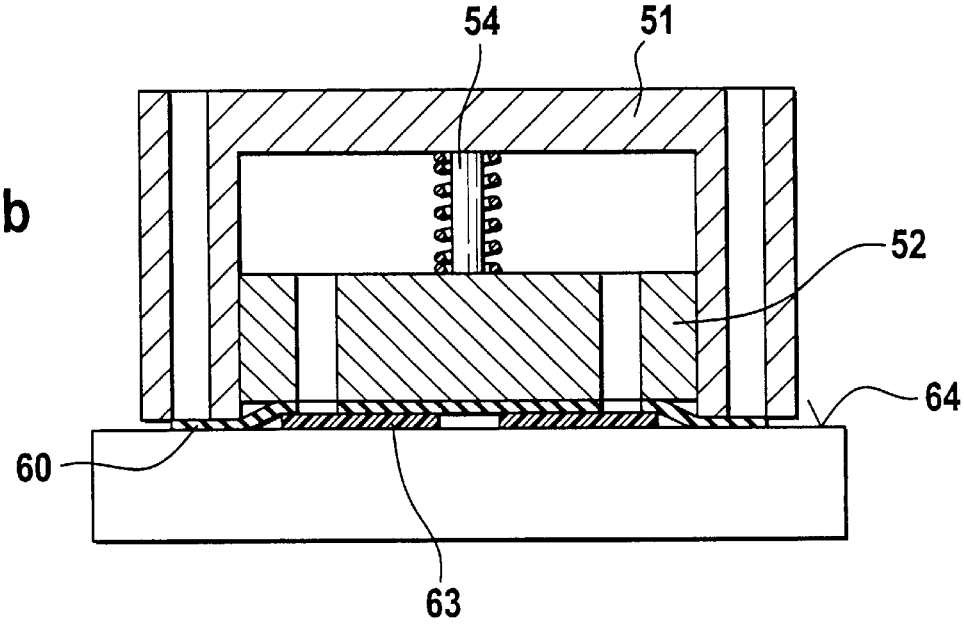

FIG. 12*b* shows that by means of the outer cylinder 51 the foil 60 can be pressed onto a level surface 64 while the inner cylinder 52 is pressed up by the compact disk 63 positioned on the surface 64 against the pressure of the spring 54.

The suction head according to the invention therefore serves as both retaining device for foil and compact disk and as compression device for pressing the preferably self-adhesive foil onto a surface.

What is claimed is:

1. An apparatus for attaching a data carrier disk to a surface of a print medium, comprising a suction head essentially consisting of an external cylinder having first vacuum passages with an outlet and an internal cylinder movably guided within the external cylinder by means of a spring with a stroke element guided therein and biasing the internal cylinder against the outer cylinder, wherein the suction head is capable of gripping and retaining a foil having perforations that coincide with the outlet of the second vacuum passages such that a compact disk can be sucked onto the foil and wherein the retained foil is pressed together with the disk onto a level surface of the medium.

* * * * *